United States Patent [19]

Walkhoff

[11] Patent Number: 4,730,403

[45] Date of Patent: Mar. 15, 1988

[54] PRESSURIZED SKI BOOT

[75] Inventor: Klaus Walkhoff, Kreuzlingen, Switzerland

[73] Assignee: Raichle Sportschuh AG, Kreuzlingen, Switzerland

[21] Appl. No.: 888,599

[22] Filed: Jul. 23, 1986

[30] Foreign Application Priority Data

Jul. 24, 1985 [CH] Switzerland ..... 03200/85

[51] Int. Cl.[4] ..... A43B 5/04; A43B 7/14

[52] U.S. Cl. ..... 36/119; 36/93

[58] Field of Search ..... 36/117–121, 36/71, 88, 93

[56] References Cited

U.S. PATENT DOCUMENTS

| | | | |
|---|---|---|---|
| 4,583,305 | 4/1986 | Miyamoto | 36/119 |
| 4,631,843 | 12/1986 | Annovi | 36/119 |
| 4,654,986 | 4/1987 | George | 36/119 |
| 4,662,087 | 5/1987 | Beuch | 36/119 X |

FOREIGN PATENT DOCUMENTS

| | | | |
|---|---|---|---|
| 0155908 | 9/1985 | European Pat. Off. | 36/119 |
| 2456612 | 6/1975 | Fed. Rep. of Germany | 36/93 |
| 2845824 | 5/1979 | Fed. Rep. of Germany | 36/119 |
| 3427644 | 1/1986 | Fed. Rep. of Germany | 36/119 |

*Primary Examiner*—James Kee Chi

*Attorney, Agent, or Firm*—Lowe, Price, LeBlanc, Becker & Shur

[57] ABSTRACT

A sports shoe (1) is provided with air chambers underneath a comparatively rigid outer shell (2) such that pressure in these air chambers, i.e., the compression on the foot, can be adjusted by a pump system (5, 6). The design of the pump system is simple, easy to manufacture, compact and operationally reliable due to the valves (14, 15) of the pump system being enclosed in a common housing part (13) separated by a partition (20) from the membrane pump chamber (11). The valves (14, 15) are mounted coaxially in tandem sequence. The evacuating valve (15) can also serve as the pump suction valve and is provided at an end (37) with a manually displaceable stem which, during evacuation of the air chamber, wil make contact with the valve stem (b 32) of the pump pressure valve (14).

22 Claims, 17 Drawing Figures

Fig. 2
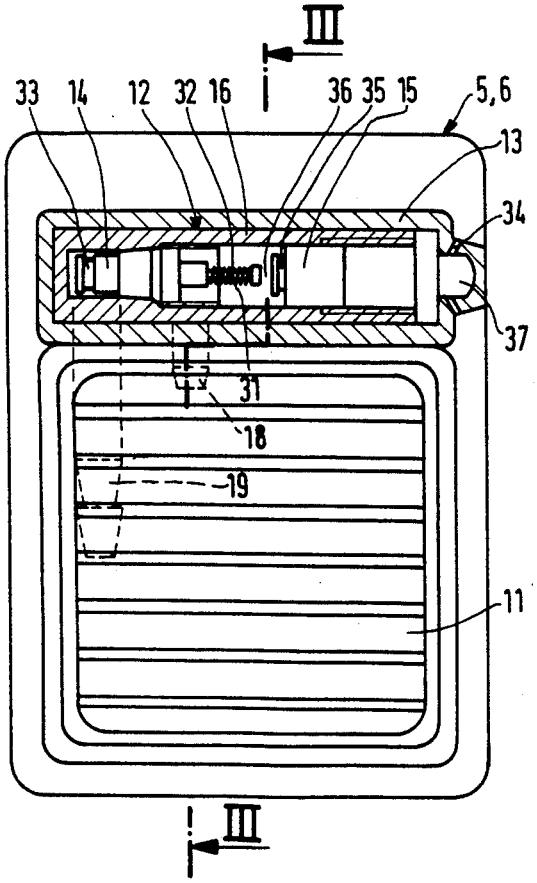
Fig. 3
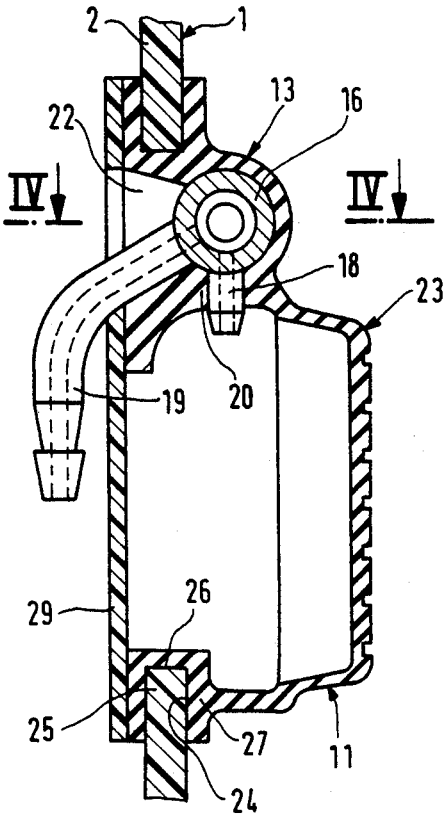
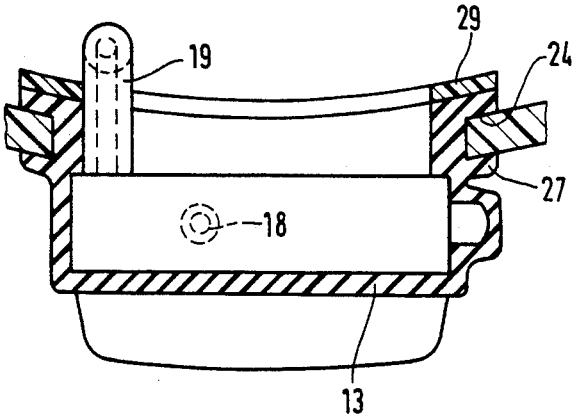
Fig. 4

Fig.5
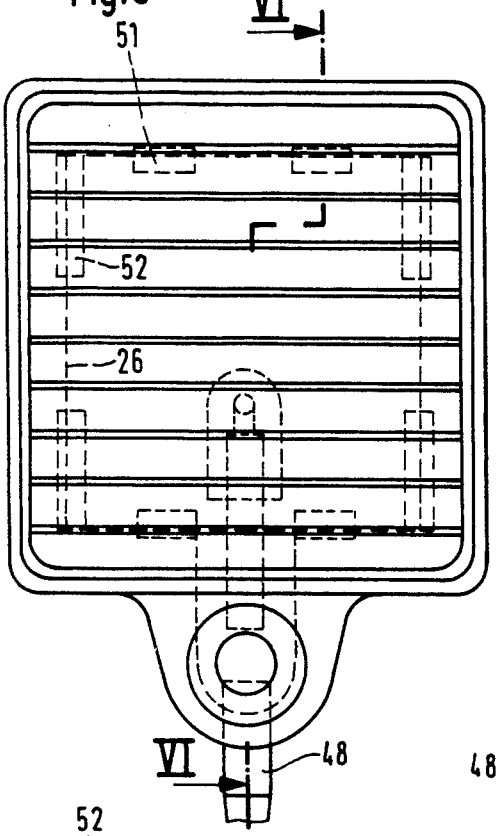
Fig.6
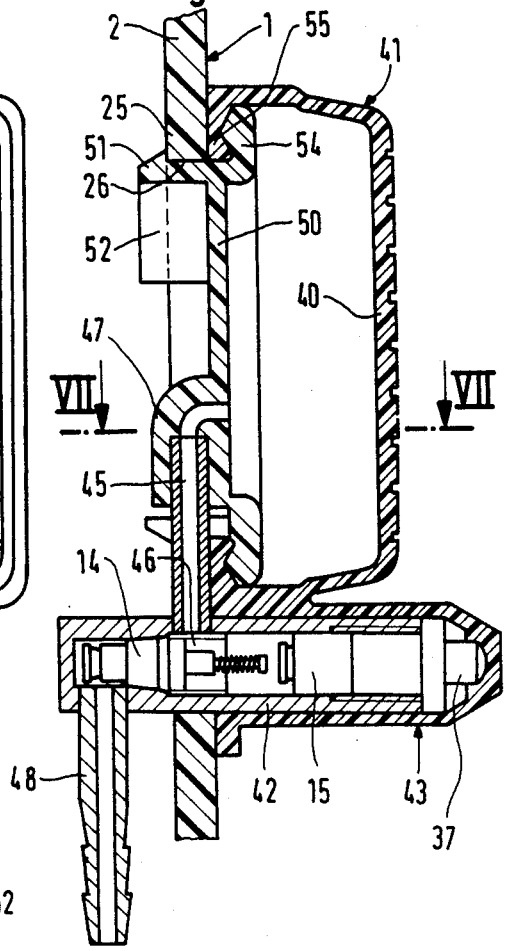
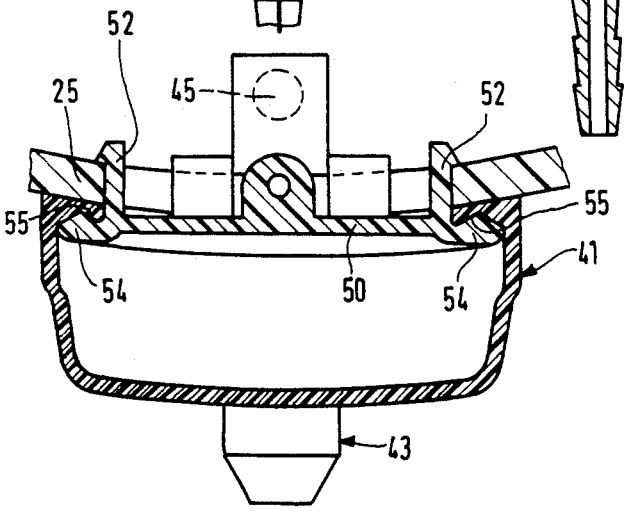
Fig.7

Fig.15
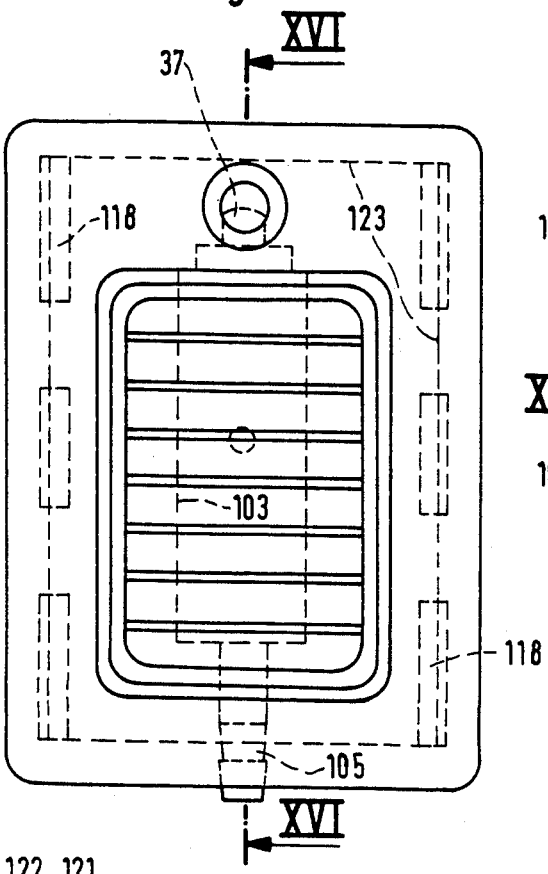
Fig.16
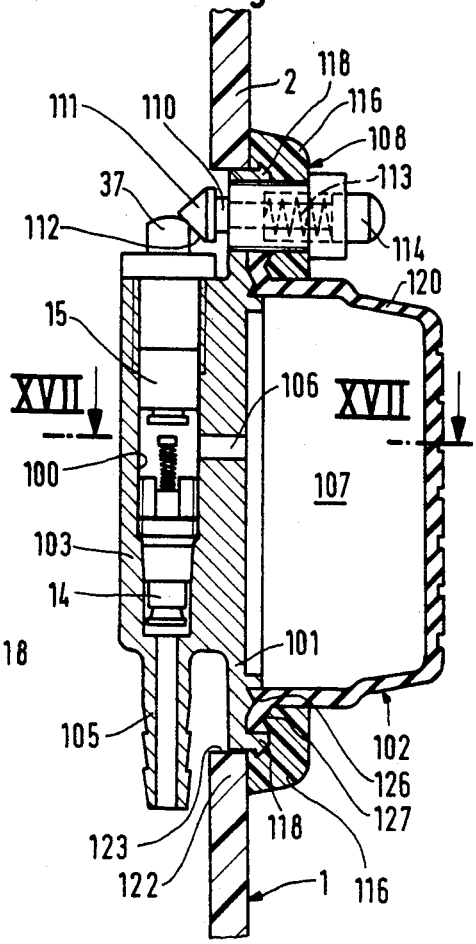
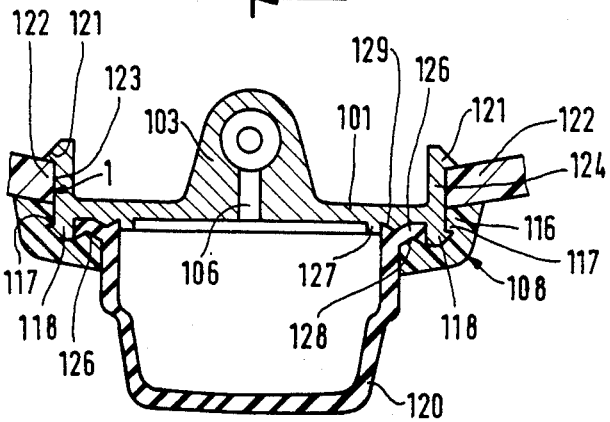
Fig.17

PRESSURIZED SKI BOOT

TECHNICAL FIELD

The invention is directed generally toward sport shoes, and more particularly toward air pressurized ski boots.

BACKGROUND ART

An air pressurized ski boot is known from the German Offenlegungsschrift No. 2 316 014, where a pump-pressure valve enters a membrane-pump chamber and is actuated externally through a flap present in the wall of the membrane pump chamber to vent the inflatable air chamber. Accordingly, the membrane pump chamber may be actuated only from outside the region provided for the pump pressure valve when pumping is in progress and hence proper actuation will not necessarily be assured. Moreover, the assembly of the pump pressure valve to the membrane pump chamber and to the shoe is complex, and so also is the assembly of the entire pumping system to the shoe.

German Offenlegungsschrift No. 33 10 812 discloses a pump system to inflate an air chamber inside a ski boot where the pump pressure valve is mounted in the wall of the membrane pump chamber. Screwing tight a closure element will seal the flow path from the pump chamber to the air chamber. This closure element is mounted next to the pump chamber and is provided with a manually actuated venting valve allowing the evacuation of the air chamber when the closure element is shut. This pump system is relatively complex and, furthermore, not particularly convenient because the closure element must first be screwed in or out when a user is inflating or evacuating the air chamber.

DISCLOSURE OF THE INVENTION

An object of the invention is to so improve a sports shoe of the above kind that it can be manufactured easily on account of a simple, compact design of its pump system that makes possible simple operation of its pump system with low susceptibility to malfunction.

By combining the valves in their own housing or in a housing part next to the membrane pump chamber, the pump can be readily operated by pressing on the membrane pump chamber, without thereby affecting the valves. Such compact mounting of the valves in their own housing or housing part substantially facilitates their assembly to the shoe.

Preferably, the pump pressure valve and the evacuation valve are mutually coaxially enclosed in a tubular housing chamber and the evacuation valve is externally operable by means of a valve stem.

Further advantageous embodiments of the invention are discussed in the description below and are best understood with reference to the drawings.

BRIEF DESCRIPTION OF THE DRAWINGS

FIG. 2 is a front view, partly in section, of the pumping means of FIG. 1, FIG. 3 is a cross-section along line III—III of FIG. 2, FIG. 4 is a cross-section along line IV—IV of FIG. 3 lacking installed valves, FIG. 5 is a front view of the pump system of a second embodiment of a shoe of the invention, FIG. 6 is a longitudinal section of the pump system along line VI—VI of FIG. 5, FIG. 7 is a cross-section of the pump system along line VII—VII of FIG. 6, FIG. 15 is a front view of a fifth embodiment of the pump system of a shoe of the invention, FIG. 16 is a cross-section along line XVI—XVI of FIG. 15, and FIG. 17 is a cross-section along line XVII—XVII of FIG. 16.

BEST MODE FOR PRACTICING THE INVENTION

Figure 1:
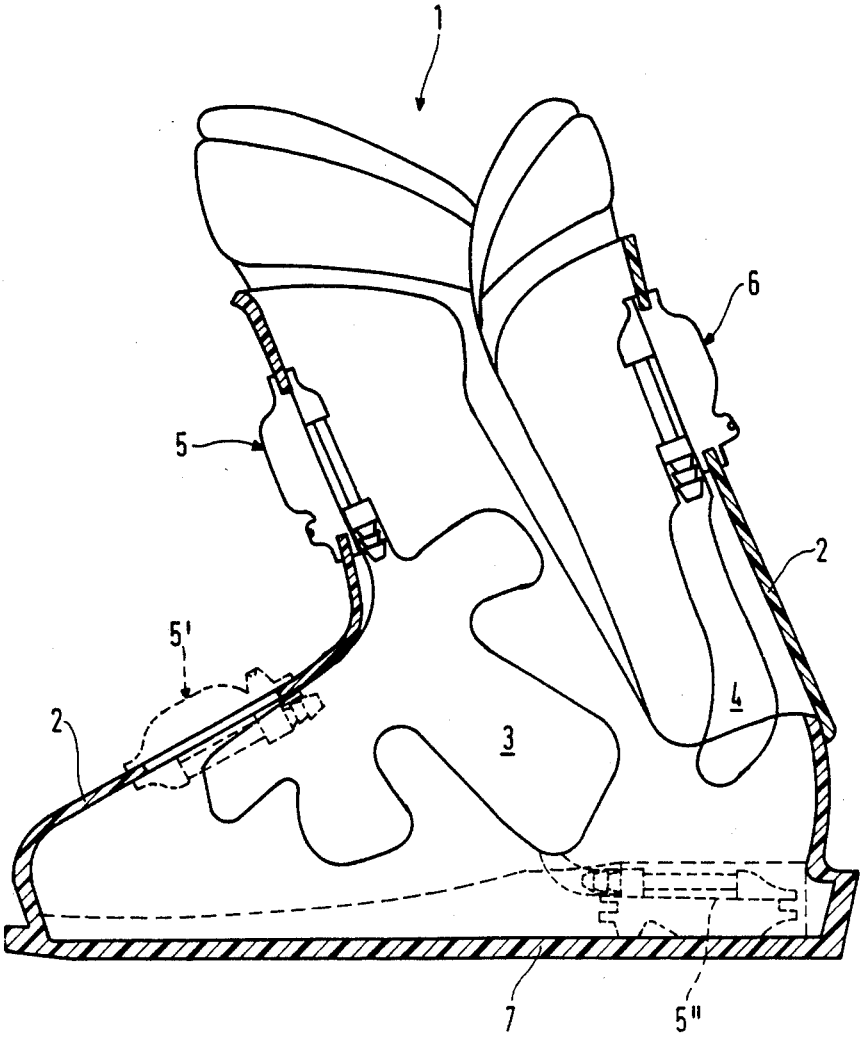
FIG. 1 is a schematic longitudinal section of a ski boot with pumping means and inflatable air chambers at various locations.

FIG. 1 shows a preferred embodiment of a sports shoe of the invention in the form of a ski boot 1. To provide the skier when skiing with a better grip by the ski boot, inflatable air chambers 3, 4 are provided underneath the comparatively rigid outer shell 2 and pushlike cushions against the skier's foot, the compression being adjustable by a corresponding actuation of a pump system 5, 6 connected to each air chamber 3, 4.

The pump systems 5, 6 can be located at various locations in the sports shoe, so that both aesthetic and practical considerations, for instance regarding an advantageous location of actuation, can be taken into account in their assembly. The dashed lines 5', 5'' indicate further other possible locations for a pump system actuating a front or rear air chamber 3, 4. For the arrangement shown in the shoe sole 7, a recessed assembly is recommended so as to leave the slipping properties of the sole 7 of the ski boot 1 on a base plate of a ski binding (not shown) unaffected. A pump system 5'' recessed in the shoe sole 7 is placed on an elevation (not shown) in the bottom or on the top of the ski in order to be actuated by means of a rocking motion of the foot enclosed in the ski boot 1. The valves of the associated valve system will be described in further detail below and are suitably mounted for easy actuation thereof from the side of the ski boot to evacuate the associated air chamber 3.

In an embodiment of a pump system 5, 6 corresponding to FIGS. 2 through 4, a membrane pump chamber 11 and an elongated housing part 13 receiving the valve system 12 are made integrally from a rubber-elastic material. The valves, i.e., an evacuation valve 14 designed to also serve as a pump pressure valve and a pump suction valve 15 are enclosed in a common rigid sleeve 16 (for instance, made of brass) and facilitating assembly of the valves 14, 15 and furthermore preventing undesired mechanical effects on the valves 14, 15 for instance during pumping. Two radially projecting stubs 18, 19 are located on this sleeve 16, one of which passes through a partition 20 to provide communication with the membrane pump chamber 11 and the other providing communication with an air chamber 3, 4. The short stub 18 also anchors the sleeve 16 in the housing part 13 provided with a lateral assembly opening 22.

The total housing 23 consisting of the rubber material and including both the pump chamber 11 and the housing part 13 is provided with a peripheral groove 24 entered by the edge 25 of a receiving aperture 26 in the outer shoe shell 2 in order that the pump system of the embodiment of FIGS. 2 through 4 be anchored. The pump system 5, 6 is inserted in this receiving aperture 26 from the shoe inside by elastically deforming the outer groove edge 27. A strengthening plate 29 bonded, for instance, by adhesion or vulcanization with the side of the total housing 23 which faces the shoe inside, prevents the pump system from being forced out of the receiving aperture 26 to the outside.

The valves 14, 15 enclosed in the sleeve 16 are arranged in tandem. After the elastically deforming membrane pump chamber 11 is depressed, the air flows through the stub 19 and the pump pressure valve 14 into the air chamber 3, 4. As is known for vehicle wheel valves, the pump pressure valve 14 is equipped with an actuation stem 32 enclosed by a helical spring 31, this stem being depressed to evacuate the air chamber 3, 4 so that the valve closure element 33 is lifted off the valve seat. To allow depressed this actuation stem 32, the evacuation valve 15 is mounted coaxially to the pump pressure valve 14 by means of its also displaceable valve stem. At the end of the latter is located the valve closure element 35, at an axial distance 36 from this element, where this distance slightly exceeds the stroke of the valve closure element 35 during pumping. The other end 37 of the valve stem of the evacuation valve 15 projects axially outward beyond the sleeve 16, so that it can be manually depressed until the valve stem 32 of the pump pressure valve 14 also has been moved into an open valve position. The evacuation actuation end 37 illustratively also is enclosed by the rubber-elastic deforming housing part 13, whereby the valves 14, 15 are protected. Small apertures 34 near the end 37 allow air suction.

The embodiment of a pump system shown in FIGS. 5 and 6 differs from the previously described one in that the valve arrangement is different and in that there is another connection to the outer shell 2 of the ski boot 1. The common longitudinal axis of the valves 14, 15 is perpendicular to this outer shell 2 and parallel to the direction of the pump motion when the rubber-elastic outer wall 40 of the membrane pump chamber 41 is depressed like a membrane. The housing part 43 enclosing the valve system and its housing sleeve 42 again is made of one piece of a rubber-elastic material but, in this instance, it projects like a stud outward beyond the membrane pump chamber and therefore sharply rises above it so that accidental evacuation during pumping is reliably averted. The communication duct 45 between the membrane pump chamber 41 and the valve system 14, 15 issuing between the two valves 14, 15 into the space 46 enclosed by the housing sleeve 42 passes through an elbow 47 parallel to the plane of the outer shoe shell 2 or in this plane. The stub 48 providing communication with an air chamber 3, 4 extends parallel to and offset from this duct 45, projecting at right angle from the housing sleeve 42.

The connection of the pump system shown in FIGS. 5 through 7 to the outer shell 2 of the ski boot 1 is implemented by several snap-in hooks 51, 52 provided at an insert 50 which, during assembly of the pump system, elastically snap into position behind the edge 25 of the receiving aperture 26. They are arranged as indicated by the dashed lines in FIG. 5. The insert 50 engages from behind in a positive lock, and by means of outwardly projecting edge 54, an inwardly directed fastening flange 55 of the membrane pump chamber 41 whereby the insert 50 keeps the pump system compressed against the outer shell 2 of the ski boot 1. The receiving aperture 26 provided to assemble this pump system of FIGS. 5 through 7 to this outer shell can be selected in view of this kind of connection to be more compact than in the embodiment previously described, as comparison of FIGS. 2 and 5 will show. Their contour is indicated by dashed lines in FIG. 5.

Figure 8:
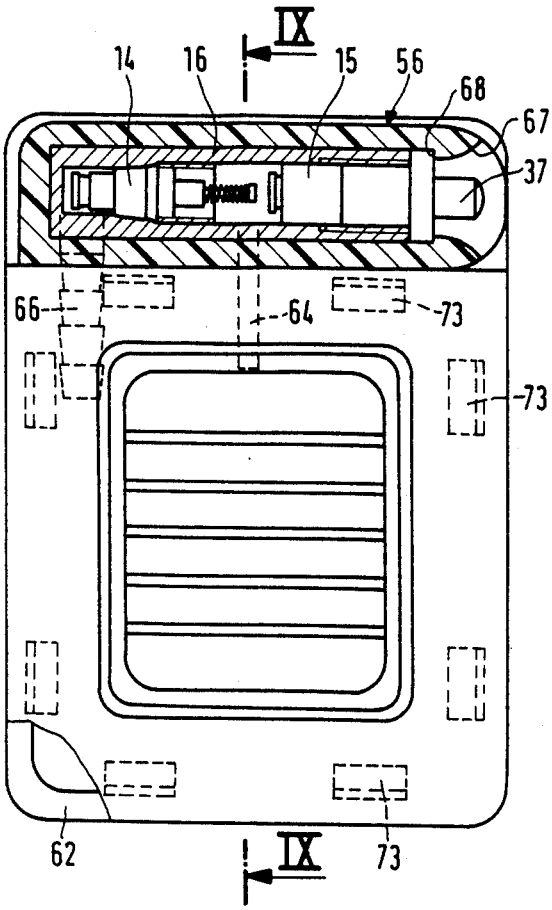
FIG. 8 is a front view, partly in section, of a third embodiment of a pump system of a shoe of the invention.
Figure 9:
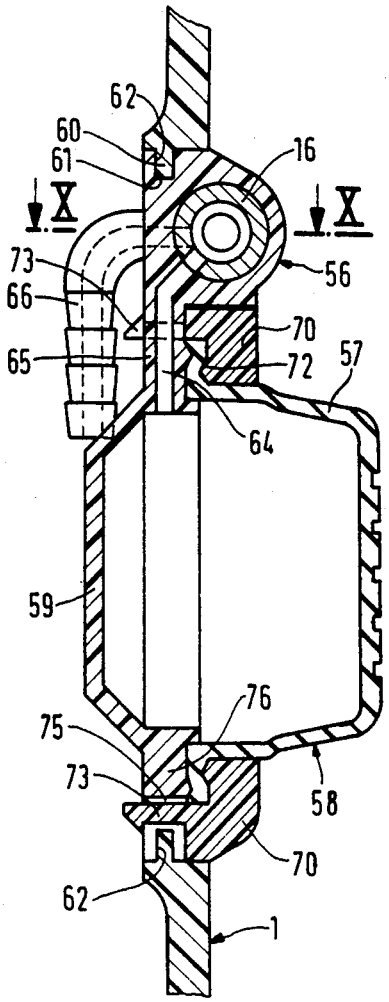
FIG. 9 is a longitudinal section of the pump system along the line IX—IX of FIG. 8.
Figure 10:
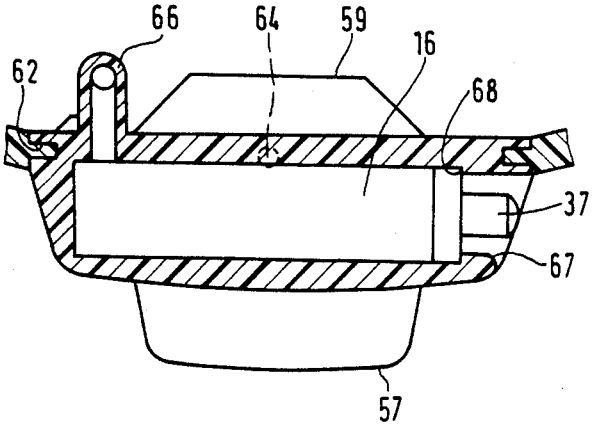
FIG. 10 is a cross-section of the pump system along line X—X of FIG. 9.
Figure 11:
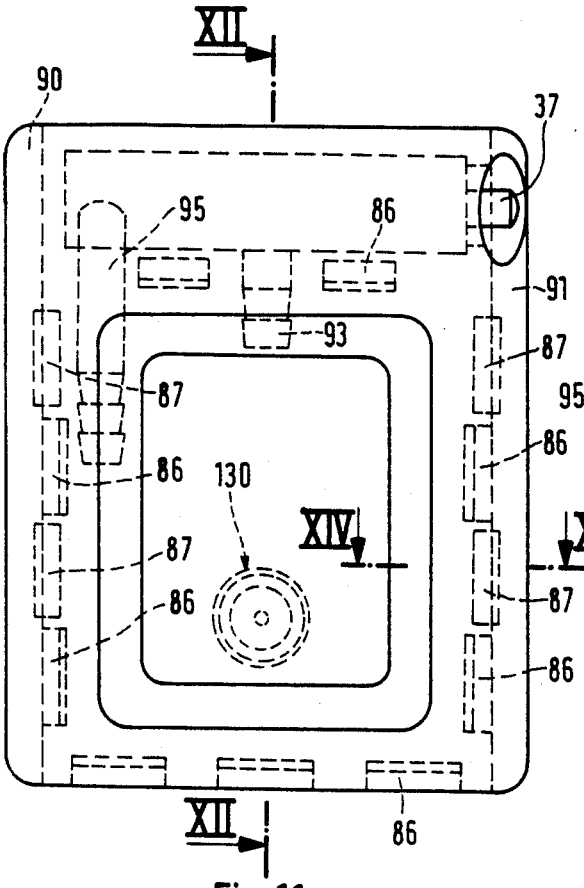
FIG. 11 is a front view of a fourth embodiment of the pump system of a shoe of the invention.
Figure 12:
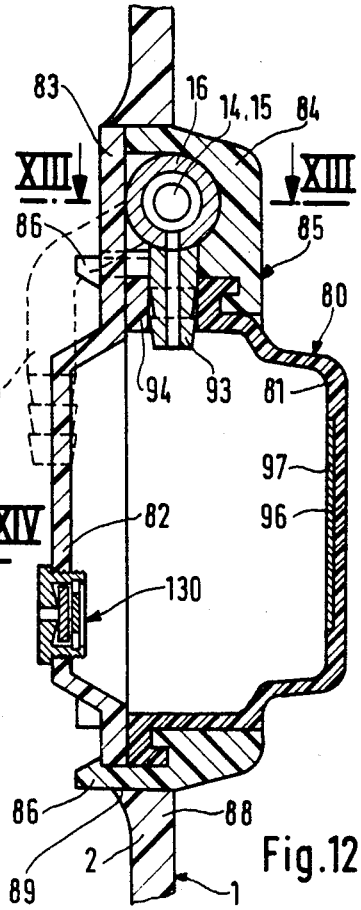
FIG. 12 is a cross-section along the line XII—XII of FIG. 11.
Figure 13:
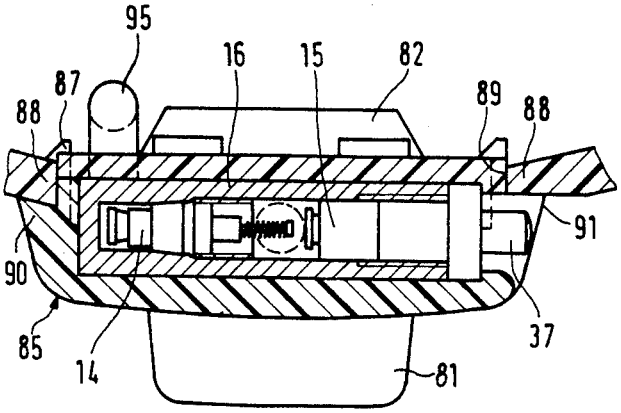
FIG. 13 is a cross-section along line XIII—XIII of FIG. 12.
Figure 14:
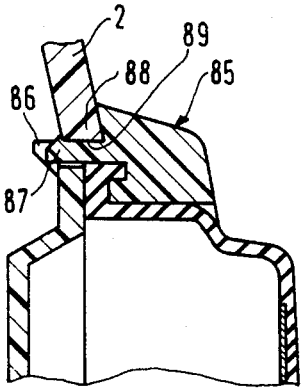
FIG. 14 is a partial cross-section along the line XIV—XIV of FIG. 11.

In the embodiment of FIGS. 8 through 10, the housing part 56 enclosing the valve system 14, 15 together with the sleeve 16 is made of an elastically deforming but more rigid material than the flap 57 of the membrane pump chamber 58 and integrally with the bottom part 59 of the membrane pump chamber 59 and is fastened by a peripheral groove 62 engaging the edge 60 of the receiving aperture 61 to the ski boot 1. The communication duct 64 between the valve system 14, 15 or its sleeve 16 and the membrane pump chamber 58 passes through wall part 65 laterally adjoining the bottom part 59, while the hook-up stub 66 leading to an air chamber 3, 4 is fixed to the housing part 56 or integrated into it. The assembly of the valve system 14, 15 of this embodiment is implemented by axially inserting the sleeve 16 enclosing the valves 14, 15 into the housing part 56. To that end, and in contrast to the previous embodiments, this housing part 56 is provided at one end with a tapering insertion aperture 67 with an undercut 68 behind which the sleeve 16 will snap into position. A fastening frame 70 is provided to fix the rubber-elastic flap 57 to the bottom part 59 of the membrane pump chamber 58 and encloses the flap 57 and in the process rests in locking manner, i.e., by means of a cross-sectional contour 72, against the radially projecting fastening flange 71 of the flap 57. Several elastic snap hooks 73 are provided at the periphery of the fastening frame 70 and pass through slots 75 in the edge 76 and in the wall part 65, and beyond the same will grip from the rear. Accordingly the rubber-elastic flap 57 is mounted in exchangeable manner.

The embodiment of FIGS. 11 through 14 is a variation of the embodiment of FIGS. 8 through 10 in that the membrane pump chamber 80 also includes a separate detachable, rubber-elastic flap 81 and a bottom part 82 made of another material. The bottom part 82 continues on the side of the valve system 14, 15 in the form of a wall part 83 which together with a housing part 84 of the fastening frame 85 encloses the sleeve 16 of the valve system 14, 15. In a special mode of embodiment of the sports shoe 1, this bottom part 82 together with its lateral wall part 83 may consist of an area of the outer shell 2 of the shoe, or be integral with the outer shell by suitable shaping of that area. The fastening frame 85 includes several sets of elastic snap hooks 86, 87 of which some (86) point inward in order to grip from below the edge of the bottom part 82 while others (87) point outward to grip from behind the edge 88 of the receiving aperture 89 in the outer shell 2. Also, the fastening frame 85 rests by its lengthwise edges 90, 91 on this aperture edge 89, the outwardly pointing snap hooks 87 being located at those lengthwise edges 90, 91.

The sleeve 16 enclosed between the wall part 83 and the housing part 84 of the fastening frame 85 is connected to a stub 93 extending through the side wall 94 of the flap 81. Another stub 95 of the sleeve 16 passes through the wall 83. This system is shown most clearly in FIG. 12 and is easily assembled by plugging together the parts. The strengthening plate 97 mounted to the outer wall 96 causes a larger deformation of the flap 81 during pumping and therefore enhances the pumping effectiveness.

In the embodiment of FIGS. 15 through 17, the sequential and coaxial valves 14, 15 of the valve system are mounted directly, without an enclosing sleeve 16, in a bore 100 extending through the fitting 103 integrated into the bottom plate 101 of the pump system or of the membrane pump chamber 102. This bracket extends across the center of this bottom plate 101 on the side facing the shoe inside. The connection stub 105 to connect the pump system with an air chamber 3, 4 forms an extension toward the valve receiving bore 100 and is of one piece with the bottom plate 101. A cross-bore 106 between the bore 100 and the inside space 107 serves as the flow channel of the pump system. In this embodiment of the invention the actuation end 37 to evacuate the air chambers 3, 4 is mounted within the outer shell 2 of the shoe, and an actuation stem 110 passes through the bottom plate 101 and the fastening frame 108 and rests by a bevel 112 at its one end 111 against the actuation end 37 of the stem of the evacuation valve 15. A spring 113 keeps the actuation stem 110 in its initial position, so that only the outwardly projecting end 114 of the actuation stem 110 needs to be depressed for venting.

Contrary to the embodiments of the FIGS. 8 through 14, the fastening frame 108 lacks snap-in hooks. Instead, the frame edge 116 is provided with an inside undercut 117 engaged by the snap-in hooks 118 at the edge of the bottom plate 101 after the rubber-elastic flap 120 has been placed into the fastening frame 108. These snap-in hooks 118 merge at the side of the bottom plate pointing to the shoe inside into inner snap-in hooks 121 for fastening the receiving aperture 123 provided in the outer shell 2 of the shoe 1, whereby each pair of snap-in hooks 118, 121 forms a claw 124 enclosing the inner edges 116 and 122 of the fastening frame and of the shoe's outer shell. Again it is possible with this embodiment of the invention to assemble the pump system by means of the fastening frame before this pump system is moved into the receiving aperture 123 for snap-in emplacement. The radially projecting flange-like edge 126 of the rubber-elastic flap 120 is reliably held on the bottom plate 101 by resting inwardly against a peripheral rib 127 of the bottom plate 101 and additionally, by positively engaging by means of cross-sectionally contoured grooves 128, 129 corresponding cross-sectional projections of the bottom plate 101 and of the fastening frame 108.

Instead of using the evacuation valve 15 to aspire air into the membrane pump chamber 11, 41, 58, 80, 102, as discussed above, an additional suction valve may be provided which issues into the pump chamber. Such a suction valve 130 is shown schematically in FIGS. 11 and 12. This suction valve 130 is known per se and may be designed to be a check valve in the form of a membrane valve and is set into the bottom plate 59 of the pump chamber 58.

Where such a suction valve 130 is provided, the evacuation valve 15 may remain as before to be an additional pump suction valve. However, to simplify the design, the valve 15 may be designed to be exclusively an evacuation valve.

It is understood herein that an additional suction valve 130 as described above may be provided in all embodiments of the invention.

I claim:

1. A sports shoe, having an inflatable air chamber, enclosed underneath an outer shell of the shoe and disposed in the form of a cushion to be adjacent a foot of the shoe wearer, and a pump system connected to the air chamber that includes a membrane pump chamber and a valve system with a pump pressure valve followed in the direction of venting therefrom by an evacuation valve, said pump system being set into a receiving aperture provided therefor in the outer shell of the shoe, characterized in that:

said valves of the valve system are enclosed in a common housing part mounted next to the membrane pump chamber.

2. The sports shoe as in claim 1, further comprising:

a pump suction valve having a valve stem that includes a projecting actuation end and is displaceable in a direction of opening until said suction valve stem makes contact with an actuation stem of the pump pressure valve to open this pump pressure valve to evacuate the air chamber.

3. The sports shoe as in claim 2, wherein:

said valves of the valve system are enclosed in a sleeve that is in turn enclosed at least partly by a housing part of the pump system.

4. The sports shoe as in claim 1, wherein:

the housing part includes an assembly aperture, disposed crosswise to the direction of a longitudinal axis of the valve system, allowing the installation through said aperture of the valve system into the housing part.

5. The sports shoe as in claim 1, wherein:

the housing part comprises an assembly aperture, disposed in the direction of a longitudinal axis of the valve system so that an actuation end of a valve stem to evacuate the air chamber is mounted to this assembly aperture.

6. The sports shoe as in claim 1, wherein:

the membrane pump chamber has a rubber-elastic, flapshaped part and the housing part receiving the valve system is integral therewith.

7. The sports shoe as in claim 1, wherein:

the membrane pump chamber is provided with a flap-like component which can be elastically deformed from the outside of the shoe, and this chamber is sealed on the side facing the inside of the shoe by a bottom plate.

8. The sports shoe as in claim 7, wherein:

the shoe has a bottom plate and the flap-shaped part is connected by an enclosing fastening frame to the bottom plate, the fastening frame engaging the bottom plate in a snap-in manner.

9. The sports shoe as in claim 8, wherein:

snap-in hooks are provided integral with the fastening frame, and engage the bottom plate from behind.

10. The sports shoe as in claim 8, wherein:

the pump system is fixed by the fastening frame to the outer shell of the shoe by means of snap-in hooks integral with the fastening frame engaging from the rear edge of a receiving aperture provided in the outer shell of the shoe.

11. The sports shoe as in claim 7, wherein:

the pump system is fastened by snap-in hooks integral with the bottom plate to a receiving aperture provided in the outer shell of the shoe, where these snap-in hooks engage from behind the edge of this receiving aperture.

12. The sports shoe as in claim 11, wherein:

the elastically deforming flap-shaped part of the membrane pump chamber is provided with an inwardly pointing fastening flange which is engaged from behind by an outwardly projecting edge of the bottom plate.

13. The sports shoe as in claim 7, wherein:

the bottom plate of the pump system is integral with the outer shell of the shoe.

14. The sports shoe as in claim 1, wherein:

the housing part receiving the valve system extends parallel to the plane of that part of the outer shell of the shoe which enclosed the pump system.

15. The sports shoe as in claim 14, wherein:

the housing part receiving the valve system is integral with the bottom plate.

16. The sports shoe as in claim 15, wherein:

the housing part receiving the valve system is integrated in the manner of a bracket in the side of the bottom plate pointing to the inside of the shoe.

17. The sports shoe as in claim 8, wherein:

the housing part receiving the valve system forms one part of the fastening frame.

18. The sports shoe as in claim 1, wherein:

the housing part enclosing the valve system extends perpendicularly to the plane of a part of the outer shell of the shoe which surrounds the pump system and projects from the outside of the shoe.

19. The sports shoe as in claim 1, wherein:

a strengthening plate is mounted to an outer wall of the membrane pump chamber.

20. The sports shoe as in claim 1, further comprising:

an intake valve issuing into the membrane pump chamber.

21. The sports shoe as in claim 7, further comprising:

an intake valve mounted in the bottom plate sealing the membrane pump chamber.

22. The sports shoe as in claim 20, wherein:

the intake valve is mounted in the bottom plate sealing the membrane pump chamber.

* * * * *

UNITED STATES PATENT AND TRADEMARK OFFICE

CERTIFICATE OF CORRECTION

PATENT NO. : 4,730,403

DATED : 3/15/88

INVENTOR(S) : Klaus WALKHOFF

It is certified that error appears in the above-identified patent and that said Letters Patent is hereby corrected as shown below:

Column 2, lines 62-64, should read as follows:

"material. The valves, i.e., a pump pressure valve 14 and a pump evacuation valve 15 also to serve as a pump suction valve are enclosed in a common rigid"

Signed and Sealed this

Sixth Day of June, 1989

*Attest:*

*Attesting Officer*

DONALD J. QUIGG

*Commissioner of Patents and Trademarks*